US007762245B2

(12) United States Patent
Smith et al.

(10) Patent No.: US 7,762,245 B2
(45) Date of Patent: Jul. 27, 2010

(54) COMPOUND BOW

(76) Inventors: Steve C. Smith, 21061 Morningside Dr., Trabuco Canyon, CA (US) 92679; Roland T. Clark, 22052 Islander La., Huntington Beach, CA (US) 92646; William S. Craycraft, 19501 Misty Ridge, Trabuco Canyon, CA (US) 92679

( * ) Notice: Subject to any disclaimer, the term of this patent is extended or adjusted under 35 U.S.C. 154(b) by 248 days.

(21) Appl. No.: 11/799,632

(22) Filed: May 1, 2007

(65) Prior Publication Data

US 2007/0256675 A1 Nov. 8, 2007

Related U.S. Application Data

(63) Continuation-in-part of application No. 10/959,026, filed on Oct. 4, 2004, now Pat. No. 7,373,934.

(51) Int. Cl.
*F41B 5/00* (2006.01)

(52) U.S. Cl. ..... 124/25.6; 124/23.1

(58) Field of Classification Search ..... 124/23.1, 124/25.6, 86, 88, 89

See application file for complete search history.

(56) References Cited

U.S. PATENT DOCUMENTS

| | | | | | |
|---|---|---|---|---|---|
| 2,714,377 | A | * | 8/1955 | Mulkey | 124/23.1 |
| 3,207,146 | A | * | 9/1965 | Grable | 124/23.1 |
| 3,486,495 | A | * | 12/1969 | Allen | 124/25.6 |
| 3,744,473 | A | * | 7/1973 | Nishioka | 124/25.6 |
| 3,957,027 | A | * | 5/1976 | Drake | 124/23.1 |
| 4,041,927 | A | * | 8/1977 | Van House | 124/61 |
| 4,091,790 | A | * | 5/1978 | Hoyt, Jr. | 124/89 |
| 4,187,826 | A | * | 2/1980 | Killian | 124/25.6 |
| 4,201,182 | A | * | 5/1980 | Butler | 124/25.6 |
| 4,207,858 | A | * | 6/1980 | Blackstone | 124/25.6 |
| 4,294,221 | A | * | 10/1981 | Bryant | 124/25.6 |
| 4,886,039 | A | * | 12/1989 | Wagner | 124/25.6 |
| 4,903,677 | A | * | 2/1990 | Colley et al. | 124/23.1 |
| 4,989,577 | A | * | 2/1991 | Bixby | 124/25.6 |
| 5,024,206 | A | * | 6/1991 | Lester | 124/23.1 |
| 5,090,395 | A | * | 2/1992 | Gannon | 124/25.6 |
| 5,092,309 | A | * | 3/1992 | Beaton | 124/35.2 |
| 5,280,779 | A | * | 1/1994 | Smith | 124/88 |
| 5,353,777 | A | * | 10/1994 | Fincher | 124/16 |
| 5,996,566 | A | * | 12/1999 | Malan | 124/23.1 |
| 6,024,076 | A | * | 2/2000 | Laborde et al. | 124/23.1 |

(Continued)

*Primary Examiner*—John Ricci
(74) *Attorney, Agent, or Firm*—Gray Law Firm; Gordon E. Gray, III

(57) ABSTRACT

The present invention is an improved compound bow. In particular, the present invention is directed to an adjustable compound bow for hunting and archery with noise reduction features. The preferred embodiment of the bow comprises a riser having a main riser length with two ends, each end attached to an adjustable hub with a limb base. Each limb base preferably has a pocketless flat surface with vibration dampening material. Each hub is secured to the main riser length by an adjustment worm drive and a hub pivot. A limb is preferably secured to each limb base at two points on the pocketless flat surface. A bowstring is strung under tension between the limbs. The bowstring's tension can be adjusted by adjusting the adjustable hubs with the worm drives. The bow preferably has a storage position and an in-use position caused by rotating the limbs around the adjustable hubs. Adjustment of the bow can be accomplished without use of a bow press.

10 Claims, 7 Drawing Sheets

U.S. PATENT DOCUMENTS 6,055,974 A * 5/2000 Dieziger ..... 124/23.1
6,360,734 B1 * 3/2002 Andrews ..... 124/23.1
6,543,432 B2 * 4/2003 Andrews et al. ..... 124/23.1
6,631,709 B2 * 10/2003 Carter et al. ..... 124/35.2
6,712,057 B2 * 3/2004 Andrews ..... 124/23.1
2003/0037778 A1 * 2/2003 Carter et al. ..... 124/35.2
2004/0187855 A1 * 9/2004 Wheeler ..... 124/25.6

* cited by examiner

COMPOUND BOW

This is a continuation-in-part application of U.S. Ser. No. 10/959,026 filed Oct. 4, 2004 now U.S. Pat. No. 7,373,934. Said patent application is incorporated herein by reference in its entirety.

TECHNICAL FIELD

The present invention is an improved compound bow. In particular, the present invention is directed to an adjustable compound bow for hunting and archery with noise reduction features.

BACKGROUND ART

Generally, a compound bow is a bow using pulleys, e.g. wheels or cams, attached to each bow limb to create, along with the bowstring, a block and tackle effect that provides force multiplying characteristics and a reduced draw weight at full draw. The invention of the compound bow is attributed to Holless W. Allen and his invention is disclosed in U.S. Pat. No. 3,486,495.

However, typical compound bows create substantial vibration and noises when fired. For example, compound bows often have limbs attached to risers in limb pockets. Limbs will typically rattle and vibrate within the limb pockets when the bow is fired. Such noises can disturb game during bow hunting and cause misses or non-fatal hits. Furthermore, bow noise often represents vibration and lost energy that could otherwise be imparted to an arrow for increased velocity and accuracy.

Moreover, typical compound bows often require the use of a bow press for adjustment and/or assembly purposes as the limbs and bowstring of a typical compound bow are under significant tension. Thus, it is often difficult, if not impossible, to adjust a compound bow while hunting. Therefore, an adjustable compound bow with reduced bow noise is desired.

SUMMARY OF THE INVENTION

The present invention is an improved compound bow. In particular, the present invention is directed to an adjustable compound bow for hunting and archery with noise reduction features. The preferred embodiment of the bow comprises a riser having a main riser length with two ends, each end attached to an adjustable hub with a limb base. Each limb base preferably has a pocketless flat surface with vibration dampening material. Each hub is secured to the main riser length by an adjustment worm drive and a hub pivot. A limb is preferably secured to each limb base at two points on the pocketless flat surface. A bowstring is strung under tension between the limbs. The bowstring's tension can be adjusted by adjusting the adjustable hubs with the worm drives. The bow preferably has a storage position and an in-use position caused by rotating the limbs around the adjustable hubs. Adjustment of the bow can be accomplished without use of a bow press.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved compound bow.

Figure 1:
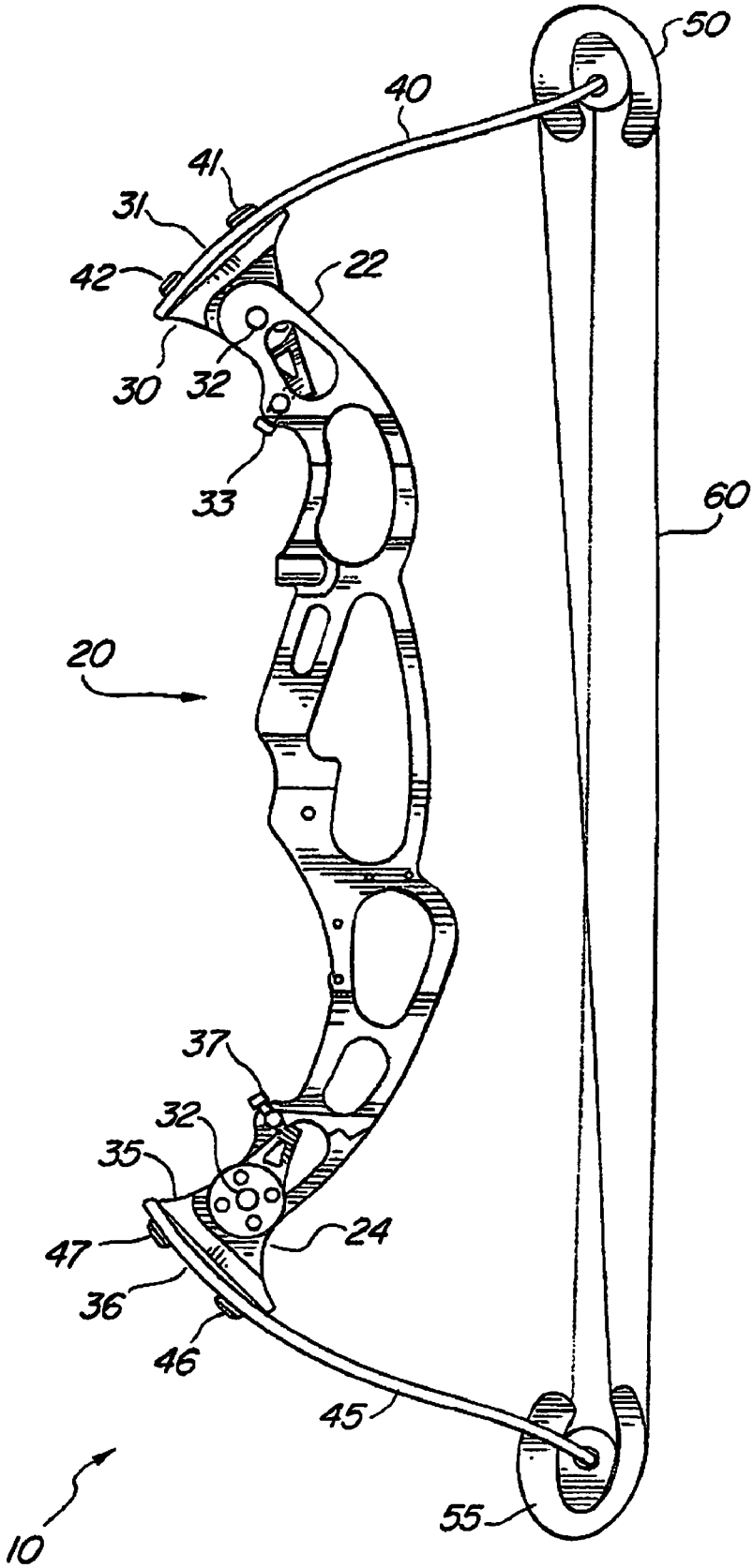
FIG. 1 is a side view of a preferred embodiment of the invention in an in-use position.
Figure 3:
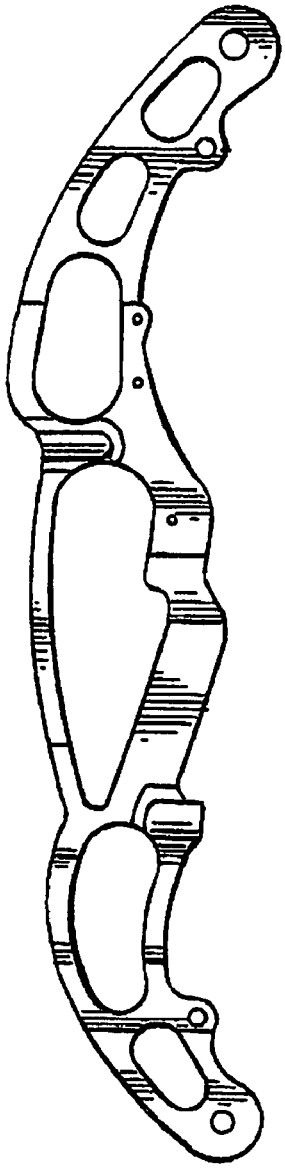
FIG. 3 is a side view of a preferred embodiment of a riser for the invention.
Figure 4:
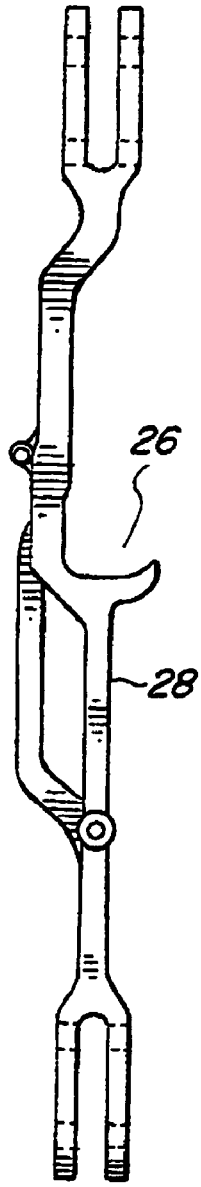
FIG. 4 is a front view of a preferred embodiment of a riser for the invention.

Referring now to FIG. 1, a preferred embodiment of the invention 10 is shown. The invention 10 is a compound bow comprising a riser 20 having main riser length 25, a first end 22 and a second end 24. Side and front views of the preferred embodiment of the riser 20 are shown in FIGS. 3 and 4 respectively. The preferred embodiment of the riser has an arrow shelf 26 and a grip 28. The riser 20 can be made of, inter alia, aluminum, aluminum-magnesium alloy, and/or aluminum-magnesium-carbon composite material.

Returning to FIG. 1, the first end 22 of the riser 20 is attached to a first adjustable hub 30 by a hub pivot 32 and a first adjustment means 33. The second end 24 of the riser is attached to a second adjustable hub 35 by a hub pivot 32 and a second adjustment means 37. The first end 22 and second end 24 are preferably forked to hold the respective hubs 30 and 35.

The first adjustment means 33 and second adjustment means 37 are preferably screws. However, the adjustment means 33 and 37 can also be, e.g., a pin, cam or a latch. The adjustment means are preferably used to adjust the poundage of the bow. Tension pins 80 and 82 pass through the adjustment means 33 and 37 respectively. The tension pins roll to allow movement of adjustment means 33 and 37.

Figure 5:
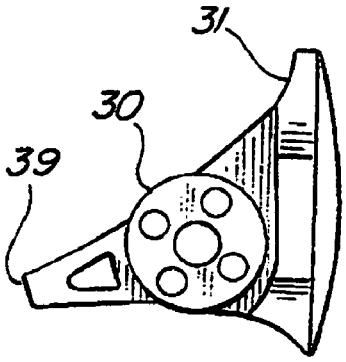
FIG. 5 is a side view of a preferred embodiment of an adjustable hub for the invention.

The first adjustable hub 30 has a first limb base 31. The second adjustable hub 35 has a second limb base 36. A preferred embodiment of the first adjustable hub 30 with limb base 31 is shown in FIG. 5. Preferably, the limb bases 31 and 36 have a flat or convex surface where limbs can be attached. Additionally, the limb bases can have a vibration dampening material, e.g. elastomer, plastic, cloth, or a composite material, on the flat or convex surface. The preferred embodiment of the first adjustable hub 30 (and the second adjustable hub 35 as well) also has an adjustment spur 39 to which the first adjustment means 33 attaches the hub 30 to the riser 20. The preferred embodiments of the first and second adjustable hubs 30 and 35 do not have limb pockets into which limbs are inserted and attached to the hubs and/or riser. The hubs 30 and 35 can have available spaces and/or slots which can be filled with dampening material, e.g. urethane, silicone, rubber, etc., to reduce vibrations Returning to FIG. 1, a first limb 40 is attached to the first limb base 31 and a second limb 45 is attached to the second limb base 36. Preferably, the first limb 40 is attached to the first limb base 40 at two points 41 and 42 and the second limb 45 is attached to the second limb base 36 at two points 46 and 47. The limbs 40 and 45 are preferably secured to their respective limb bases 31 and 36 by flat head socket cap screws. Other securing means such as bolts, rivets and/or cam locks can be used. Alternatively, the limbs 40 and 45 can be attached to their respective limb bases 31 and 36 along a span of the limb contacting the limb base, or a portion thereof. Multiple or extended attachment points between the limbs and bases provide a more fixed base and reduce noise and vibration. The limbs 40 and 45 can have limb savers mounted on their surface to reduce vibrations. The limbs 40, 45 are preferably made of, inter alia, fiberglass or carbon composite material.

A first cam 50 is preferably attached to the first limb 40 and a second cam 55 is preferably attached to the second limb 45. A bowstring 60 is strung around the cams 50 and 55 to create the "block and tackle effect" of the typical compound bow. Sound and vibration dampening items such as "cat whiskers," "string leeches," and "beaver balls," can be applied to the bowstring 60 to further reduce sound and vibration during firing.

Figure 2:
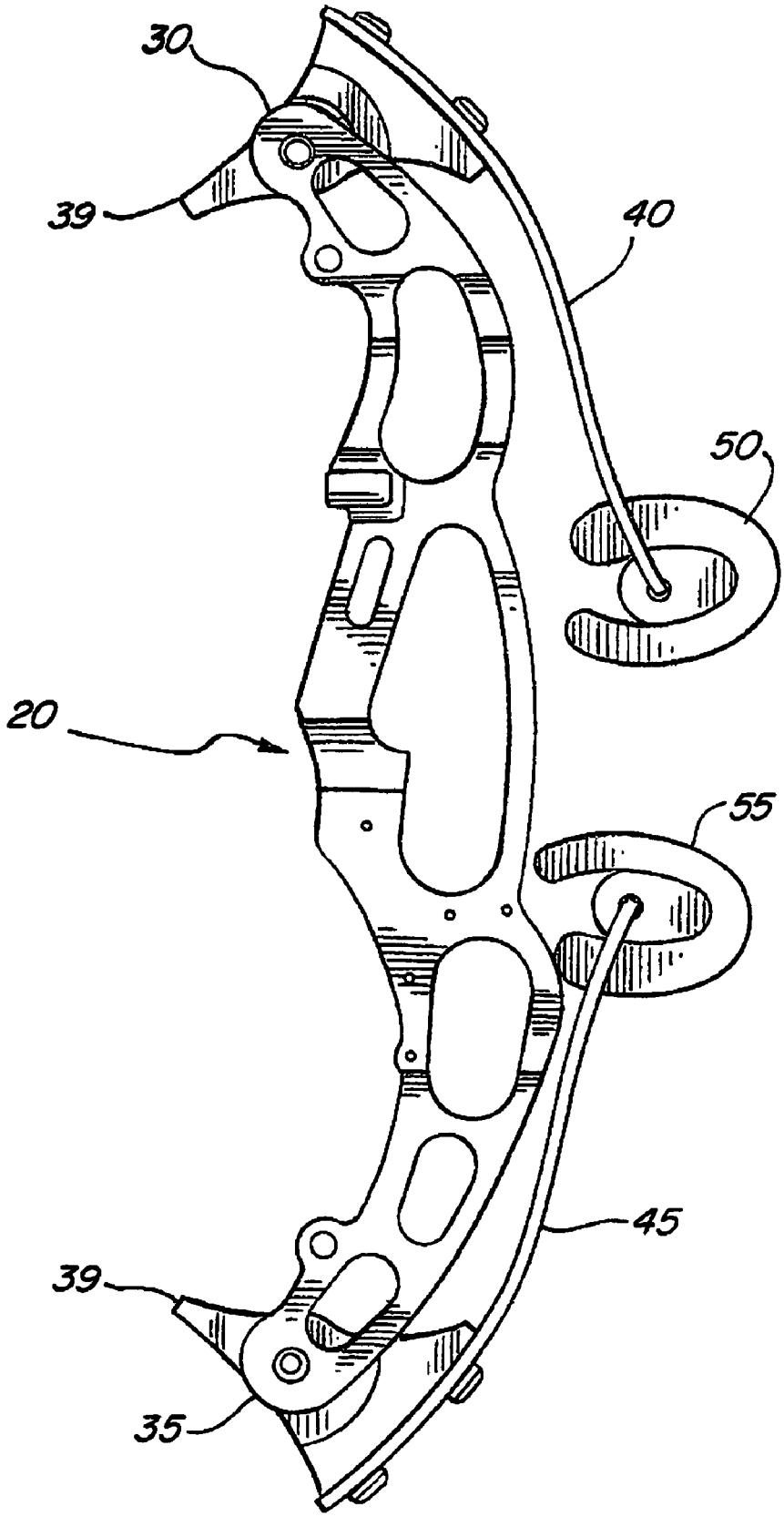
FIG. 2 is a side view of a preferred embodiment of the invention in a storage position.

Referring now to FIG. 2, a preferred embodiment of the invention 10 is shown in a storage position. The preferred embodiment of the invention is shown in an in-use position in FIG. 1. As shown in FIG. 2, the bowstring 60 has been unstrung from the bow 10. The first and second adjustment means 33 and 37 (not shown in FIG. 2) have been released from the adjustment spurs 39, thus releasing the spurs 39 from the main riser length 25. This allows the hubs 30 and 35 to rotate around the hub pivots 32 and place the limbs 40 and 45 in the more compact storage position shown in FIG. 2.

Less drastic adjustment of the adjustment means 33 and 37 allows a user to adjust a bow's brace height. The brace height of a bow is the distance between the bowstring 60 and the grip 28. An increased brace height generally means that the bow is more accurate but has less power. A decreased brace height generally means that the bow is less accurate but has more power. The general range of draw weight for the preferred embodiment of the invention is 15-100 pounds.

Without releasing the adjustment spurs 39 from the riser 20, the adjustment means 33 and 37 can adjust the brace height of the bow 10. The adjustment means 33 and 37 can be tightened or loosened to rotate the adjustable hubs 30 and 35 to move the limbs 40 and 45 and set the brace height of the bow 10. Thus, the brace height of the bow 10 can be adjusted without the use of a bow press. Moreover, the adjustment means 33 and 37 and hubs 30 and 35 allow the bow to be changed from the storage position to the in-use position (and back) without the use of a bow press.

It should be noted that when longer limbs 40, 45, e.g. 13-16 inches, are attached to the hubs 30, 35 (or a shorter riser is used), the tips of the limbs can touch each other when placed in the storage position and possibly prevent the bow from being placed in an optimum storage position. To avoid this, an alternative embodiment of the invention can comprise a riser 20 with a twist at its forked ends. The forked ends of the riser 20 are machined, cast or otherwise manufactured to cause the upper and lower forks to twist or be rotated in opposition to one another. Preferably, the upper fork is twisted 5-10 degrees clockwise and the lower forks twisted 5-10 counterclockwise. Accordingly, the hubs 30, 35 in this embodiment each preferably have an opposing twist such that when the bow is in an in-use position, the limbs 40, 45 are parallel and square to each other for accurate shooting. When the limbs 40, 45 are folded to the storage position, the twist in the riser 20 will cause the limbs 40, 45 to rotate away from each other to prevent the tips of the limbs from touching when in storage. In the storage position, the limbs 40, 45 preferably lay side by side. Another alternative would be to have a radius slot in one of the two mounting holes (41 or 42 and 46 or 47) on the limbs 40, 45. The screws or other mounting means for limbs could then be loosened when relocation to the storage position is desired. The limbs 40, 45 then rotate on the hub 30, 35 allowing the limbs to lay side by side as mentioned above.

Figure 6:
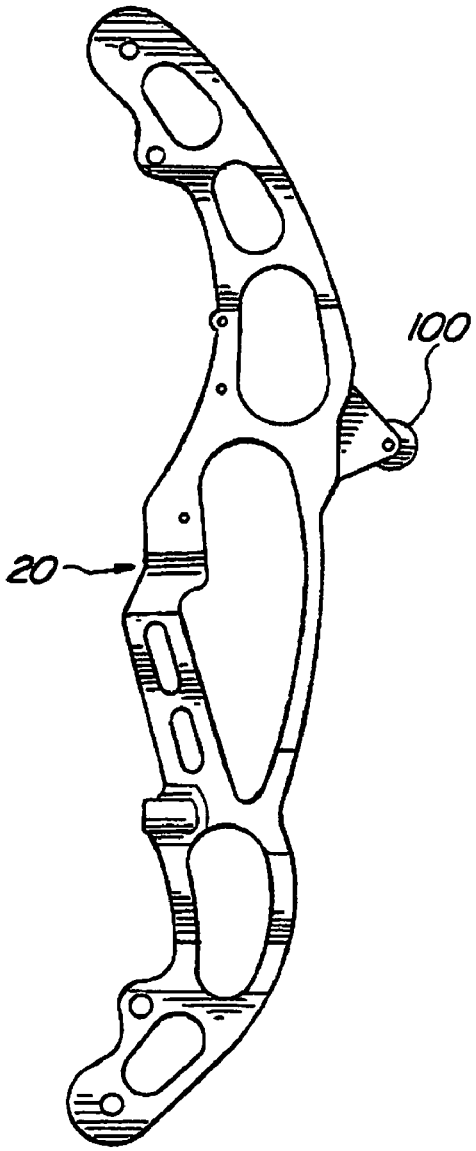
FIG. 6 is a side view of another preferred embodiment of the invention with a cable guide roller.

Referring now to FIG. 6, a side view of an alternate preferred embodiment is shown. Prior art compound bows can have a cable guide roller for the bowstring. This roller helps the bow draw more smoothly and moves the bowstring away from an arrow to be fired. However, the prior art cable guide roller is typically mounted to the riser with a cable guide roller arm or a cable guide bar with slider to distance the roller from the riser. However, when the preferred embodiments of the invention described above are placed in a storage position, a cable guide roller arm or cable guide bar with slider reduces their effectiveness for storage purposes. Thus, as shown in FIG. 6, a cable guide roller 100 mounted directly to the riser 20 is useful. By placing the cable guide roller 100 on the surface of the riser 20, the bow can be placed in both storage and in-use positions with little or no impairment.

Figure 7:
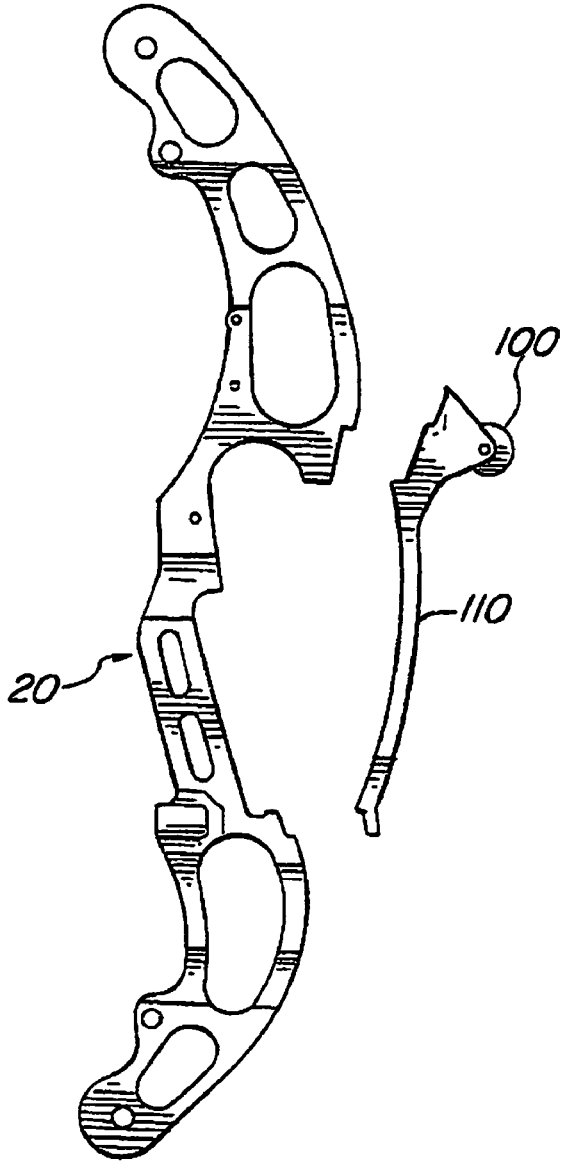
FIG. 7 is a side view of another preferred embodiment of the invention with a cable guide roller mounted to a removable bridge.

Referring now to FIG. 7, a side view of another alternative preferred embodiment is shown. In this embodiment, the cable guide roller 100 is mounted to a bridge 110 removably attached to the riser 20. The bridge 110 and roller 100 can be removed from the riser 20 when the bow is placed in a storage position. This feature can simplify manufacture of the riser 20.

Figure 9:
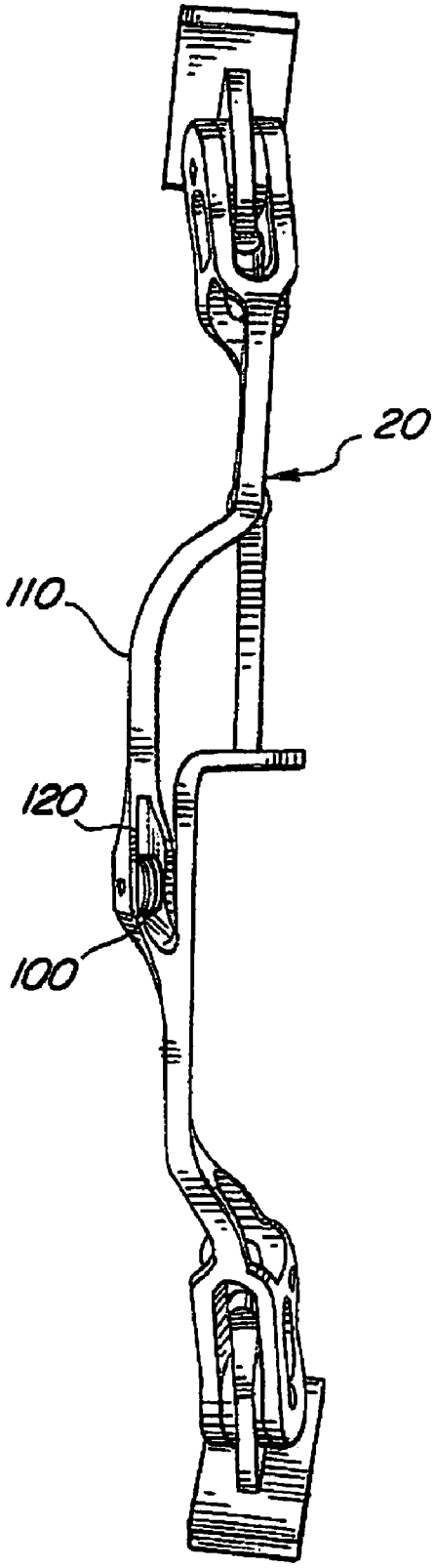
FIG. 9 is a front view of the preferred embodiment shown in FIG. 8.
Figure 8:
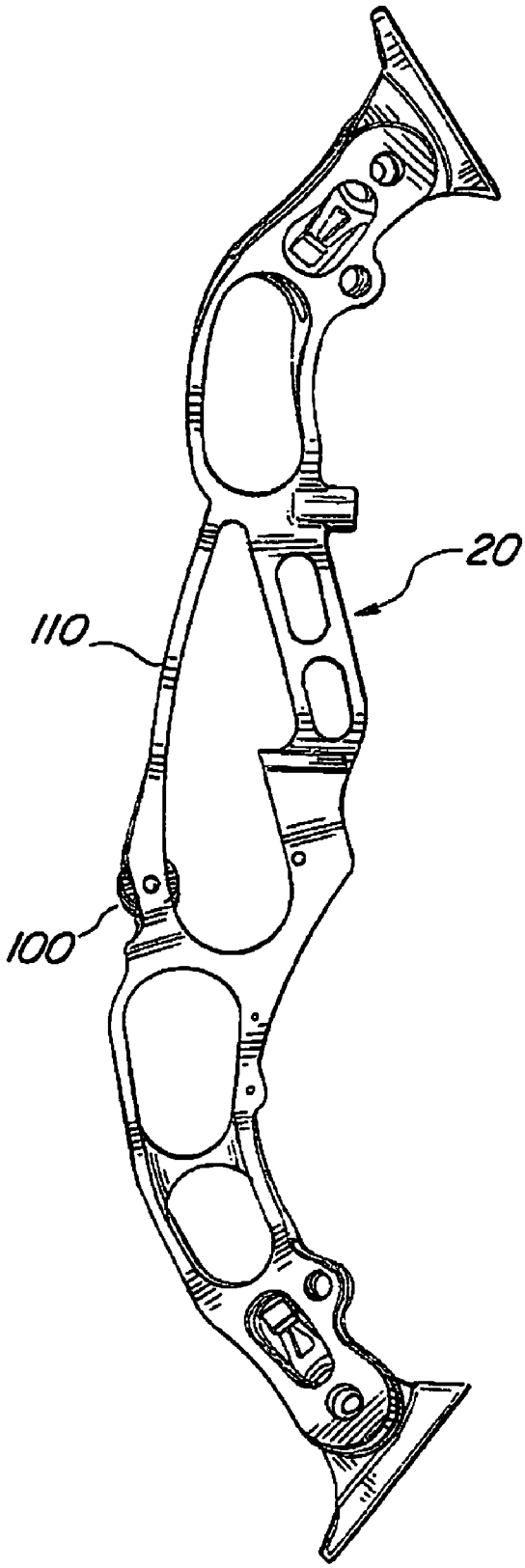
FIG. 8 is a side view of another preferred embodiment of the invention with a cable guide roller mounted in a bridge.

Referring now to FIGS. 8 and 9, another alternative preferred embodiment is shown. FIG. 8 is a side view of another alternative preferred embodiment with a cable guide roller 100. However, the roller 100 is mounted within a cable guide roller compartment 120 (also visible in FIG. 9) on the bridge 110. This embodiment is advantageous because it has fewer parts and a better control cable angle between the tips of the limbs. This improved angle places the control cables deeper into the grooves of the cable guide rollers. The roller 100, compartment 120, and bridge 110 structure can also be referred to as a cable guide mount. The bridge 110 can be removably attached to the riser 20 or fixedly attached.

Alternate Preferred Embodiments for Adjustable Hubs

Figure 10:
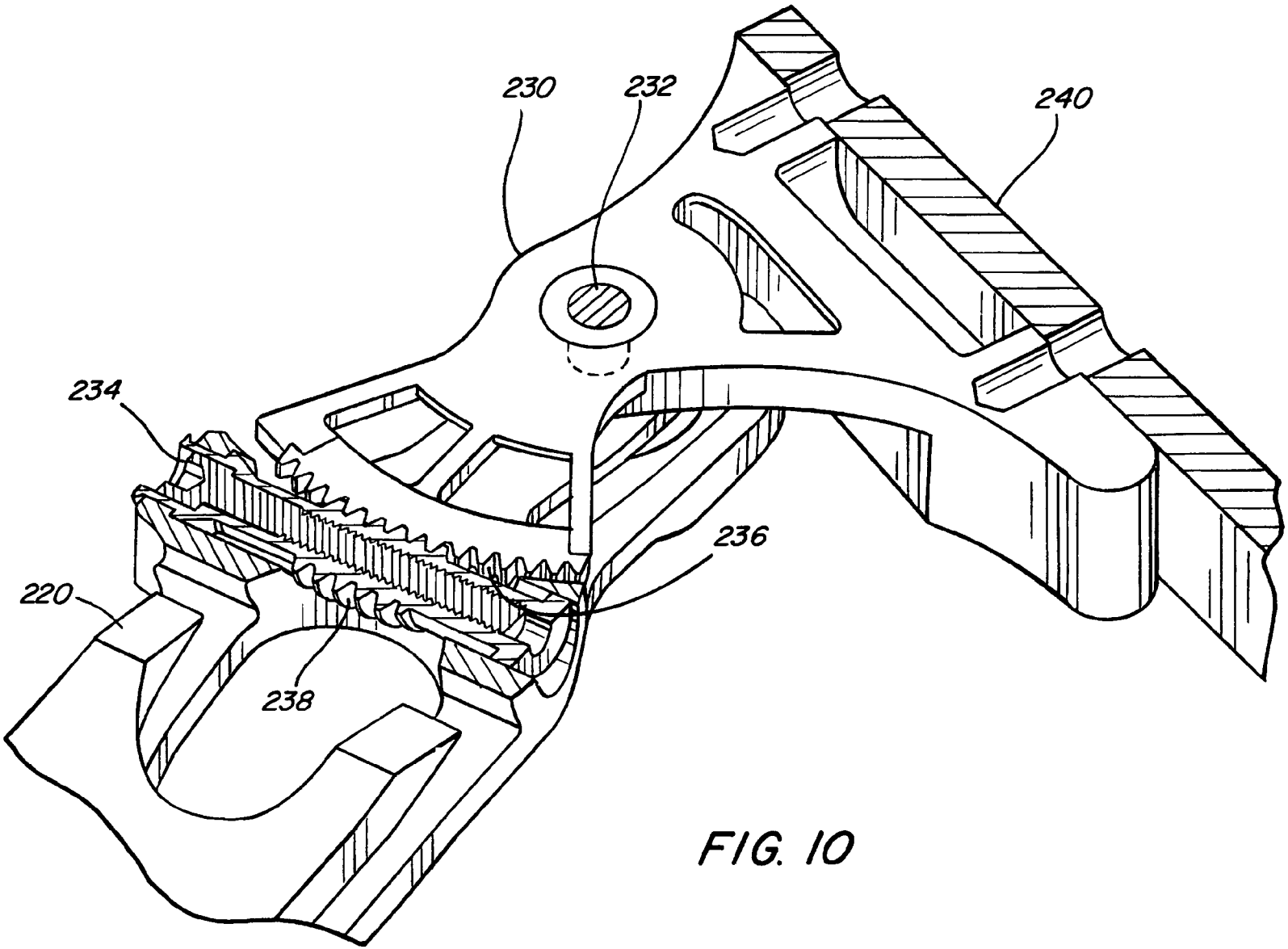
FIG. 10 is a cross-sectional view of an adjustable hub and worm gear for another preferred embodiment.

Another preferred embodiment of the present invention is herein described, particularly regarding the adjustable hubs described above. Referring now to FIG. 10, a cross-sectional view of a preferred embodiment of an adjustable hub for the compound bow is shown. A limb 240 is attached to an adjustable hub 230 which is, in turn, attached to a riser 220 at hub pivot 232 and worm drive 234. The adjustable hub 230 preferably has a radial gear section 236 with gear teeth to mesh with the thread gear section 238 of worm drive 234. Alternately, the radial gear section 236 of the hub 230 and the worm drive 234 can have a frictional, as opposed to threaded, interface.

Figure 12:
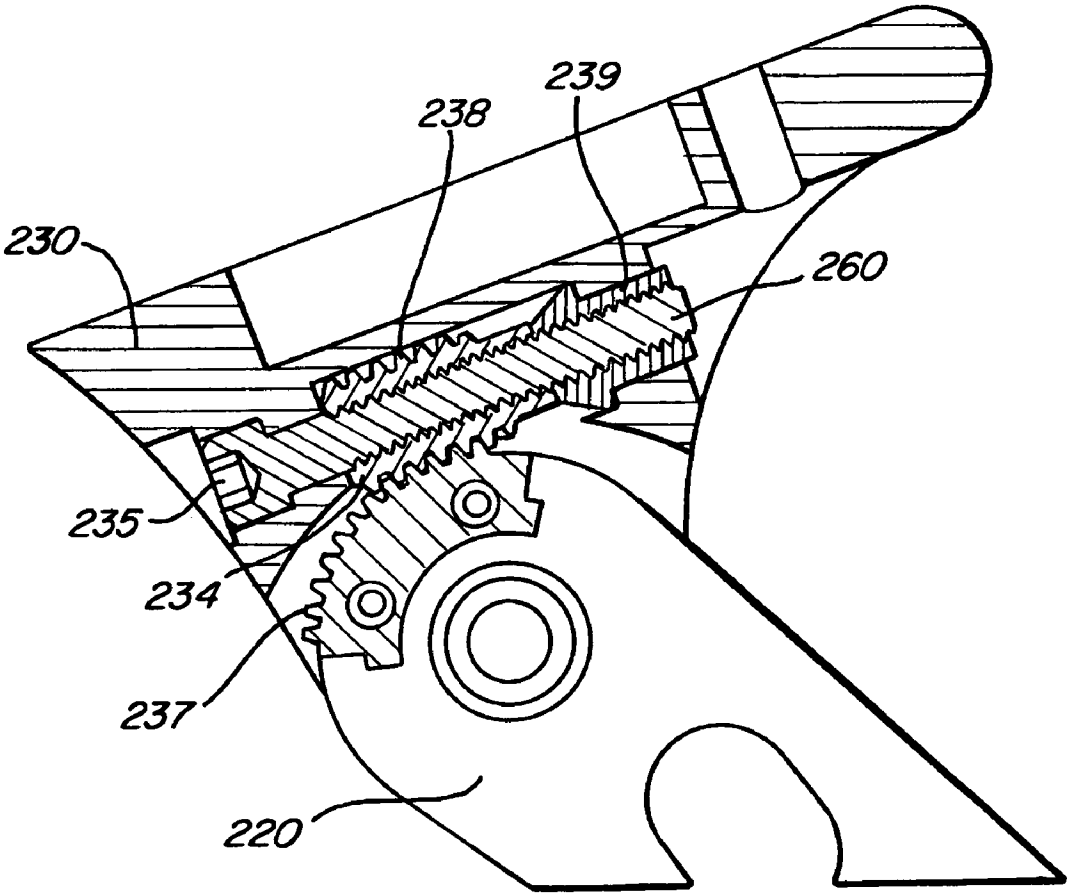
Figure 11:
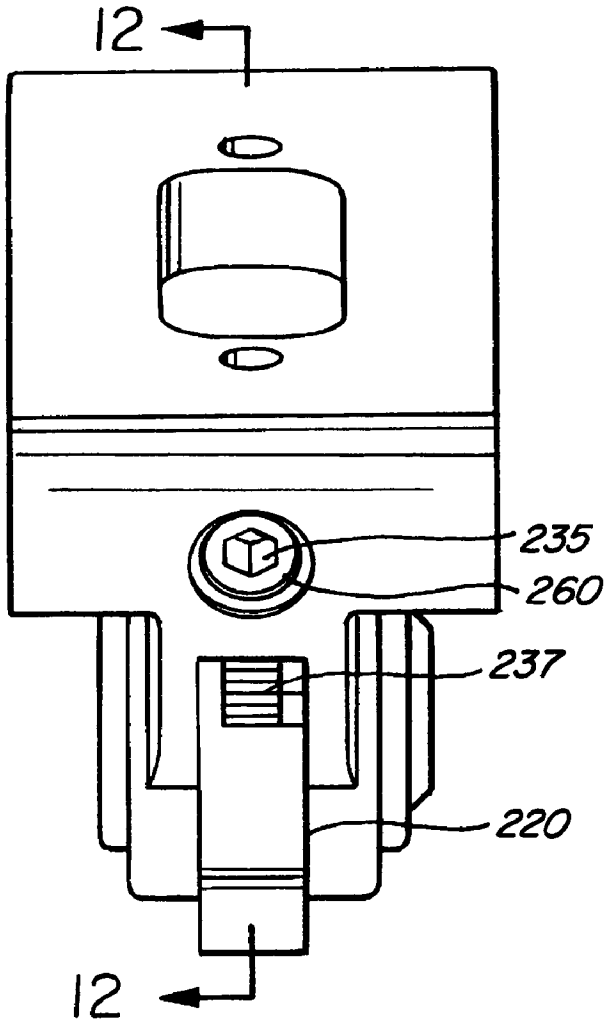
FIG. 11 is a top view of another preferred embodiment of the adjustable hub in FIG. 12; and, FIG. 12 is a side cross-sectional view of FIG. 11.

Referring now to FIGS. 11 and 12, another preferred embodiment is shown. The worm drive or worm gear 234 preferably comprises a bolt 260 inserted through a threaded gear section 238. As opposed to the embodiment of FIG. 10 where the hub 230 has radial gear section 236, a radial gear section 237 that meshes with the worm drive 234 is mounted to the riser 220. The bolt 260 is preferably mounted to the limb hub 230 at a thrust bearing 239. For the embodiment in FIG. 10 and the embodiment in FIGS. 11 and 12, the bolt 260 also preferably has a socket head 235 for easy adjustment by a tool such as an allen wrench, a wrench, a screwdriver, a socket wrench or some other simple tool.

For both embodiments, the mesh of the threaded gear section 238 of the worm drive 234 with the radial gear section 236 of the limb hub 230 or the radial gear section 237 of the riser 220 provides a user with a significant mechanical advantage for quicker and easier adjustment of the bow. Again, no bow press is required to adjust this embodiment of the bow. In fact, with a simple tool inserted into the socket head 235, the user can adjust the bow in the field for a variety of conditions or personal preferences. The preferred gearing ratio for the worm drive 234 to the radial gear is 40 to 1. A ratio of 25 to 1 or more is generally preferred for safety reasons to prevent "back-driving" (e.g. the radial gear turns the worm drive instead of vice versa) when the limb is under tension.

Thus, an improved compound bow is described above that is adjustable without a bow press and has reduced firing noise characteristics. In each of the above embodiments, the different positions and structures of the present invention are described separately in each of the embodiments. However, it is the full intention of the inventor of the present invention that the separate aspects of each embodiment described herein may be combined with the other embodiments described herein. Those skilled in the art will appreciate that adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A compound bow comprising:

a riser having a main riser length with a first end attached to an adjustable hub with a limb base;

where the adjustable hub is secured to the main riser length by a worm gear and a hub pivot; and, a limb secured to the limb base.

2. The compound bow of claim 1 where the adjustable hub further has gear teeth meshed with the worm gear.

3. A compound bow comprising:

a riser having a main riser length with a first end attached to a first adjustable hub with a first limb base, said main riser length having a second end attached to a second adjustable hub with a second limb base;

where the first adjustable hub is secured to the main riser length by a first worm gear and a first hub pivot and the second adjustable hub is secured to the main riser length by a second worm gear and a second hub pivot;

a first limb secured to the first limb base; and, a second limb secured to the second limb base.

4. The compound bow of claim 3 where the first adjustable hub further has gear teeth meshed with the first worm gear at a gearing ratio equal to or greater than 25 to 1.

5. The compound bow of claim 3 where a brace height can be adjusted by adjusting either the first or second worm gears.

6. The compound bow of claim 3 further comprising a bowstring strung under tension between the first limb and the second limb; whereby the tension of the bowstring can be adjusted by adjusting the first or second worm gears.

7. A compound bow comprising:

a riser having a main riser length with a first end attached to an adjustable hub with a limb base;

where the adjustable hub is secured to the main riser length at a hub pivot and where the adjustable hub is adjustable by a worm gear attached to the adjustable hub.

8. The compound bow of claim 7 where the first end of the riser has gear teeth meshed with the worm gear.

9. The compound bow of claim 7 where a brace height can be adjusted by adjusting the worm gear.

10. The compound bow of claim 7 further comprising a bowstring strung under tension between a first limb and a second limb; whereby the tension of the bowstring can be adjusted by adjusting the worm gear.

* * * * *